US008960665B2

(12) United States Patent
Nishimura

(10) Patent No.: US 8,960,665 B2
(45) Date of Patent: Feb. 24, 2015

(54) SHEET CONVEYANCE APPARATUS AND IMAGE FORMING APPARATUS

(71) Applicant: Canon Kabushiki Kaisha, Tokyo (JP)

(72) Inventor: Yutaka Nishimura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/012,765

(22) Filed: Aug. 28, 2013

(65) Prior Publication Data

US 2014/0062013 A1 Mar. 6, 2014

(30) Foreign Application Priority Data

Aug. 30, 2012 (JP) ..... 2012-189941

(51) Int. Cl.
*B65H 29/00* (2006.01)
*B65H 5/06* (2006.01)

(52) U.S. Cl.
CPC ..... *B65H 5/06* (2013.01)
USPC ..... 271/186; 271/184; 271/270; 271/255; 399/364; 399/401

(58) Field of Classification Search
USPC ..... 271/225, 242, 243, 245, 246, 184, 186, 271/270; 399/364, 397, 401
See application file for complete search history.

(56) References Cited

U.S. PATENT DOCUMENTS

| | | | | |
|---|---|---|---|---|
| 5,482,265 | A * | 1/1996 | Nakazato et al. | 271/242 |
| 5,599,014 | A * | 2/1997 | Kitahara et al. | 271/270 |
| 6,931,230 | B2 * | 8/2005 | Yasui | 399/396 |
| 7,896,341 | B2 * | 3/2011 | Kunieda et al. | 271/242 |
| 8,690,152 | B2 * | 4/2014 | Ito et al. | 271/242 |
| 2002/0063384 | A1 * | 5/2002 | Quesnel | 271/270 |
| 2013/0049294 | A1 * | 2/2013 | Takano | 271/225 |
| 2013/0099441 | A1 * | 4/2013 | Kikuchi et al. | 271/10.13 |

FOREIGN PATENT DOCUMENTS

JP 7-315622 A 12/1995

* cited by examiner

*Primary Examiner* — Ernesto Suarez
(74) *Attorney, Agent, or Firm* — Canon U.S.A., Inc. IP Division

(57) ABSTRACT

A sheet conveyance apparatus includes a first conveyance roller configured to convey a sheet, a second conveyance roller configured to convey the sheet at a variable speed ranging from a first sheet conveyance speed to a second sheet conveyance speed wherein the first sheet conveyance speed is less than a sheet conveyance speed of the first conveyance roller and the second sheet conveyance speed is greater than the sheet conveyance speed of the first conveyance roller, a driving unit configured to drive the second conveyance roller, and a control unit configured to control the driving unit.

14 Claims, 13 Drawing Sheets

SHEET CONVEYANCE APPARATUS AND IMAGE FORMING APPARATUS

BACKGROUND

1. Field

Aspects of the present invention generally relate to a sheet conveyance apparatus and an image forming apparatus, and more particularly to the sheet conveyance speed control of conveyance rollers when eliminating a loop formed on a sheet.

2. Description of the Related Art

Conventionally, an image forming apparatuses, such as a copying machine, a facsimile machine, and a printer, has a plurality of conveyance rollers. The image forming apparatus has a sheet conveyance apparatus that uses the plurality of conveyance rollers to convey a sheet to a transfer unit and a fixing unit or, when forming an image on both sides of a sheet, to a two-sided conveyance path. To increase productivity, some sheet conveyance apparatuses have conveyance rollers, which have different sheet conveyance speeds, on the sheet conveyance path depending on the intended use.

However, when the sheet conveyance speed differs between the neighboring conveyance rollers, a loop (mountain-shaped bend) is sometimes formed in a sheet between the conveyance rollers due to a difference of the sheet conveyance speeds or, conversely, a loop is sometimes eliminated when the sheet is pulled. When a loop is eliminated, a sheet sometimes collides with the guide plate of the sheet conveyance path, generating a noise. In addition, when a loop is eliminated with a sheet rubbing against a guide member, the image or the sheet may be damaged.

This phenomenon frequently occurs in a curved sheet conveyance path due to the shape of the sheet conveyance path and the orientation of a sheet. To address this problem, Japanese Patent Application Laid-Open No. 7-315622 discusses the following configuration. That is, to reduce a noise or to reduce rubbing between a sheet and a guide member when a loop is eliminated, the guide member is configured to freely swing when a loop portion of the sheet abuts on the guide member.

However, the above-described conventional sheet conveyance apparatus has a complex configuration for guide-member swing, which makes the apparatus large and expensive. In addition, a recent image forming apparatus is becoming even more productive and a paper-to-paper distance is becoming shorter. This configuration sometimes causes a guide member, which is swung because of a loop in the preceding sheet, to collide with the following sheet when the guide member returns to the original position. In this case, the noise becomes larger.

To realize higher productivity, a recent image forming apparatus tends to control predetermined conveyance rollers to increase the sheet conveyance speed quickly. This conveyance control quickly eliminates a loop formed on a sheet, and causes the sheet to collide with a guide plate with the result that the noise is generated more frequently.

SUMMARY

The present disclosure is directed to a sheet conveyance apparatus and an image forming apparatus capable of reducing a noise generated when a loop in a sheet is eliminated.

According to an aspect of the present invention, a sheet conveyance apparatus includes a first conveyance roller configured to convey a sheet, a second conveyance roller configured to convey the sheet at a variable speed ranging from a first sheet conveyance speed to a second sheet conveyance speed, wherein the second conveyance roller is arranged downstream of the first conveyance roller in a sheet conveyance direction side by side, wherein the first sheet conveyance speed is less than a sheet conveyance speed of the first conveyance roller and the second sheet conveyance speed is greater than the sheet conveyance speed of the first conveyance roller, a driving unit configured to drive the second conveyance roller, and a control unit configured to control the driving unit, wherein the control portion controls the driving unit so that the second conveyance roller, in conjunction with the first conveyance roller, conveys a sheet at the sheet conveyance speed of the second conveyance roller as the first sheet conveyance speed to generate a loop on the sheet until the second conveyance roller conveys the sheet a predetermined amount. After the second conveyance roller has conveyed the sheet the predetermined amount, an acceleration is switched while the sheet conveyance speed of the second conveyance roller is increased from the first sheet conveyance speed to the second sheet conveyance speed, and the loop is eliminated while the sheet conveyance speed of the second conveyance roller is increased with a lower acceleration of accelerations before and after the switching.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the disclosure will be described in detail below with reference to the drawings.

The exemplary embodiments given below are only examples. The sizes, materials, shapes, and relative arrangements of the components described below are not seen to be limiting.

Figure 1:
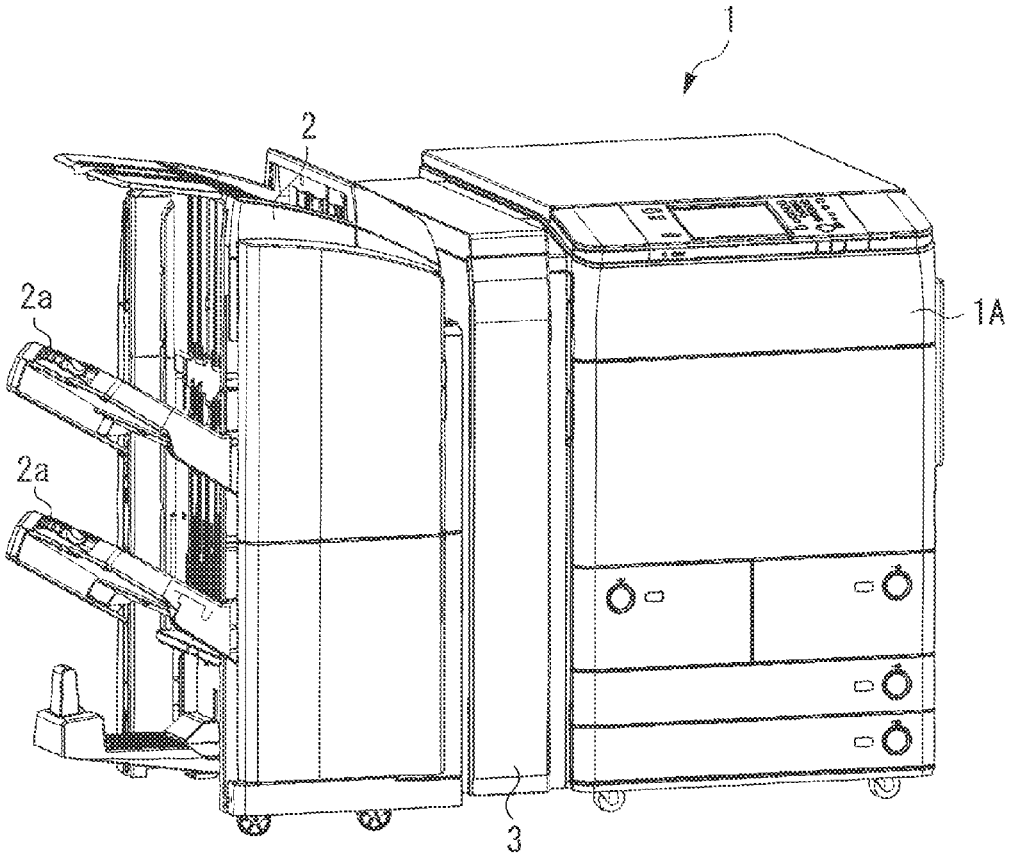
FIG. 1 is a perspective view illustrating a color laser printer that is an example of an image forming apparatus having a sheet conveyance apparatus according to a first exemplary embodiment.
Figure 2:
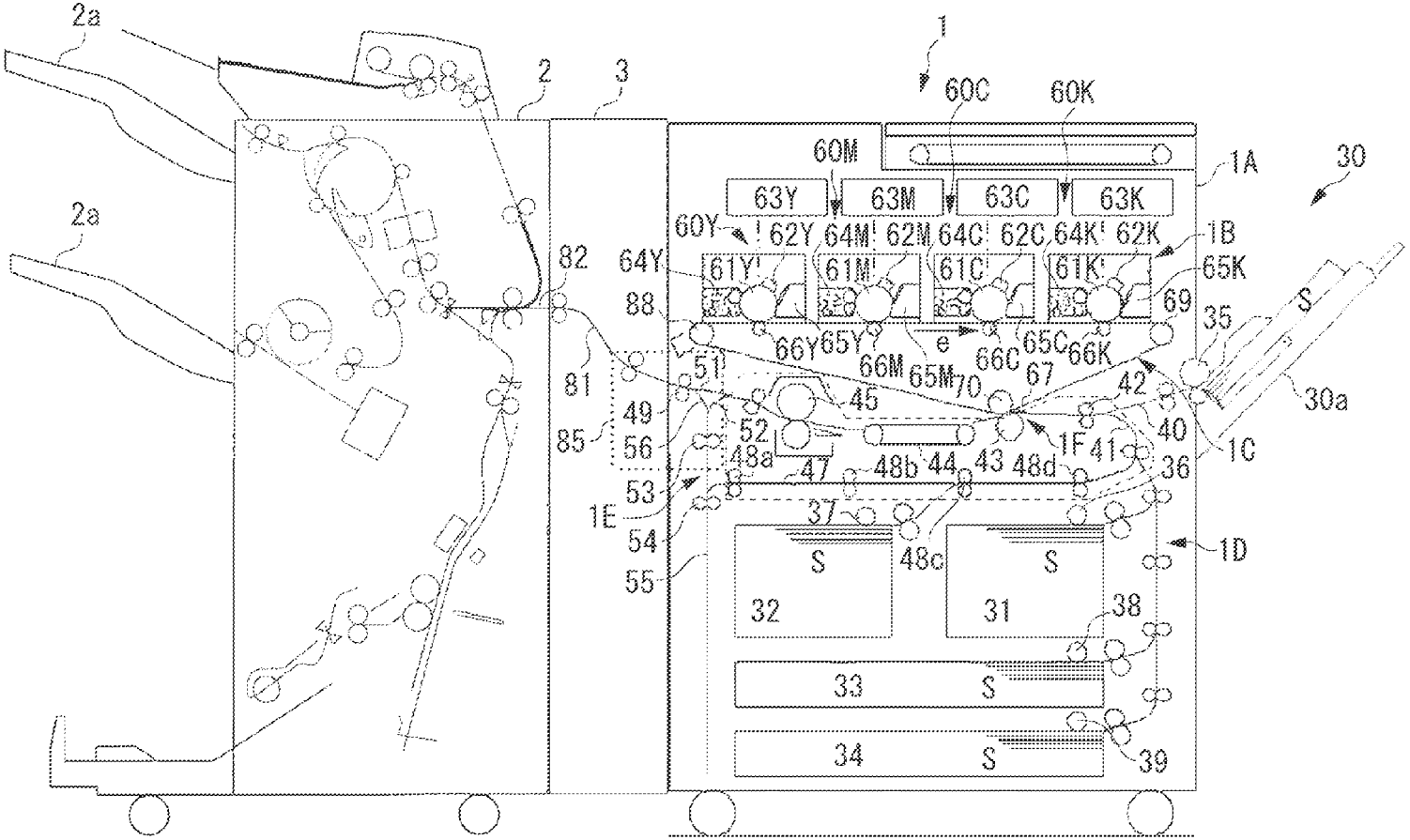
FIG. 2 is a diagram illustrating a general configuration of the color laser printer.

FIG. 1 is a perspective view illustrating a color laser printer that is one example of an image forming apparatus having a sheet conveyance apparatus according to a first exemplary embodiment. FIG. 2 is a diagram illustrating a general configuration of the color laser printer. FIG. 1 and FIG. 2 illustrate a color laser printer 1 and a printer body (image forming apparatus body) 1A. A sheet processing apparatus 2, which performs the folding processing, staple processing, punch processing, and bookbinding processing for a sheet output from the printer body 1A, is connected to one side of the printer body 1A. A buffer unit 3, which includes a curl correction device not illustrated, is provided between the printer body 1A and the sheet processing apparatus 2.

The printer body 1A includes an image forming unit 1B that forms a toner image, an intermediate transfer unit 1C, a fixing device 45, a sheet feeding device 1D that feeds a sheet S to the image forming unit 1B, and a manual sheet feeding device 30 that allows the user to manually feed a sheet. This color laser printer 1 can form an image also on the back side of a sheet. To that end, a re-conveyance unit 1E is provided to reverse a sheet S with an image formed on the front side (one side), and convey the reversed sheet S again to the image forming unit 1B.

The image forming unit 1B includes four process stations 60 (60Y, 60M, 60C, 60K). The four process stations, arranged approximately in horizontal direction, form a toner image in four colors, yellow (Y), magenta (M), cyan (C), and black (Bk). The process stations 60 have photosensitive drums 61 (61Y, 61M, 61C, 61K) that are image bearing members. Each of these image bearing members carries a toner image in one of the four colors, yellow, magenta, cyan, and black and is driven by a stepping motor not illustrated. The process stations 60 also include charging units 62 (62Y, 62M, 62C, 62K) which uniformly charge the surface of the photosensitive drum.

In addition, the process stations 60 include scanners 63 (63Y, 63M, 63C, 63K). These scanners 63 radiate a laser beam based on the image information to form an electrostatic latent image on the photosensitive drum that rotates at a constant speed. The process stations 60 also include developing devices 64 (64Y, 64M, 64C, 64K). These developing devices 64 apply toners of yellow, magenta, cyan, or black to an electrostatic latent image formed on the photosensitive drum, to develop the electrostatic latent image as a toner image. The charging units 62, scanners 63, and developing devices 64 are arranged around the photosensitive drums 61 along the rotational direction.

The sheet feeding device 1D, provided below the printer body, includes sheet feeding cassettes 31-34 and pickup rollers 36-39. The sheet feeding cassettes 31-34 are sheet storage units each storing sheets S. The pickup rollers 36-39 feed sheets S stacked in the sheet feeding cassettes 31-34. The manual sheet feeding device 30 includes a manual feeding tray 30*a*, which is a sheet storage unit for stacking sheets S, and a paper supply roller 35 that feeds the sheets S stacked in the manual feeding tray 30*a*.

When the image forming operation is started, the sheets S are separated and fed by the pickup rollers 36-39, one at a time, from the sheet feeding cassettes 31-34. After that, the sheet S that passes through a conveyance vertical path 41 is conveyed to a registration roller 42. In the case of manual sheet feeding, the sheets S stacked in the manual feeding tray 30*a*, are fed by the paper supply roller 35. The sheet that passes through a conveyance path 40 is conveyed to the registration roller 42. At this point, the registration roller 42, with which the sheet S collides to form a loop, has the function to align the leading edge of the sheet S to correct its skew. In addition, the registration roller 42 has the function to convey the sheet S to a secondary transfer unit 1F at a time when an image is formed on the sheet S. That is, the registration roller 42 has the function to convey the sheet S synchronously at predetermined timing when a toner image being carried by an intermediate transfer belt as described later is detected.

The intermediate transfer unit 1C includes an intermediate transfer belt 67. The intermediate transfer belt 67 is rotated along an array direction of the process stations 60 indicated by arrow B, in synchronization with the outer peripheral speed of the photosensitive drums 61. The intermediate transfer belt 67 is stretched over a driving roller 69, a driven roller 70 that forms a secondary transfer area across the intermediate transfer belt 67, and a tension roller 68 that applies appropriate tensile force to the intermediate transfer belt 67 by the urging force of a spring not illustrated.

The intermediate transfer belt 67 has, in its inside, four primary transfer rollers 66 (66Y, 66M, 66C, 66K) that, in conjunction with the respective photosensitive drums 61, pinch the intermediate transfer belt 67 to configure a primary transfer unit. The primary transfer rollers 66 are connected to a transfer bias power-source not illustrated. When the transfer bias is applied from the primary transfer rollers 66 to the intermediate transfer belt 67, the color toner images, formed respectively on the photosensitive drums, are multiple-transferred sequentially onto the intermediate transfer belt 67. As a result, a full-color image is formed on the intermediate transfer belt 67.

A secondary transfer roller 43 is provided in a position opposed to the driven roller 70. The secondary transfer roller 43 abuts on the lowest surface of the intermediate transfer belt 67 and works with the intermediate transfer belt 67 to pinch and convey the sheet S which has been conveyed by the registration roller 42. When the sheet S passes through the nip portion between the secondary transfer roller 43 and the intermediate transfer belt 67, the bias is applied to the secondary transfer roller 43. By application of the bias, a toner image formed on the intermediate transfer belt, is secondarily transferred onto the sheet S. The fixing device 45 fixes the toner image formed on the sheet via the intermediate transfer belt 67, on the sheet S. The toner image on the sheet S is fixed by heat and pressure that are applied when the sheet S passes through the fixing device 45.

Next, the image formation operation of the color laser printer 1 with the above configuration is described below. When the image formation operation is started, the scanner 63Y directs a laser to the photosensitive drum 61Y in the process station 60Y, which is located in the most upstream side in the rotation direction of the intermediate transfer belt 67, to form a yellow latent image on the photosensitive drum. After that, the developing device 64Y develops the latent image with yellow toner to form a yellow toner image.

Next, the yellow toner image formed on the photosensitive drum 61Y in this manner, is primarily transferred onto the intermediate transfer belt 67 in the primary transfer area by the transfer roller 66Y to which a high voltage is applied. Next, the toner image, together with the intermediate transfer belt 67, is conveyed to a primary transfer area configured by the photosensitive drums 61M and the transfer rollers 66M of the process station 60M. In the process station 60M, an image is formed after the toner-image conveyance time has elapsed from the time the toner image is formed in the process station 60Y.

A next magenta toner image is transferred with the leading edge of the image aligned with the yellow toner image on the intermediate transfer belt 67. After that, the similar process is repeated. As a result, the four-color toner image is primarily transferred on the intermediate transfer belt 67, and the full-color image is formed on the intermediate transfer belt 67. A small amount of transfer residual toner on the photosensitive drums 61 is recovered by photosensitive cleaners 65 (65Y, 65M, 65C, 65K) for use in the next image formation.

In parallel with the toner image formation operation, the sheets S stored in the sheet feeding cassettes 31-34 are separated and fed, one at a time, by the pickup rollers 36-39 and are conveyed to the registration roller 42. In the case of manual sheet feeding, the sheets S stacked in the manual feeding tray 30*a* are fed by the paper supply roller 35. The sheet that passes through the conveyance path 40 is conveyed to the registration roller 42. At this point, the registration roller 42 is in the stopped state. By causing the sheet S to collide with the registration roller 42 in the stopped state, a skew in the sheet S is corrected. After the skew is corrected, the sheet S is conveyed to the nip portion between the secondary transfer roller 43 and the intermediate transfer belt 67 by the registration roller 42. The registration roller 42 starts rotating at the timing that the leading edge of the sheet coincides with the toner image formed on the intermediate transfer belt 67.

The sheet S is pinched and conveyed by the secondary transfer roller 43 and the intermediate transfer belt 67. When passing through the nip portion between the secondary transfer roller 43 and the intermediate transfer belt 67, the toner image formed on the intermediate transfer belt 67 is secondarily transferred onto the sheet S by a bias applied to the secondary transfer roller 43. Next, the sheet S on which the toner image is secondarily transferred is conveyed to the fixing device 45 by a before-fixing conveyance unit 44.

Figure 3:
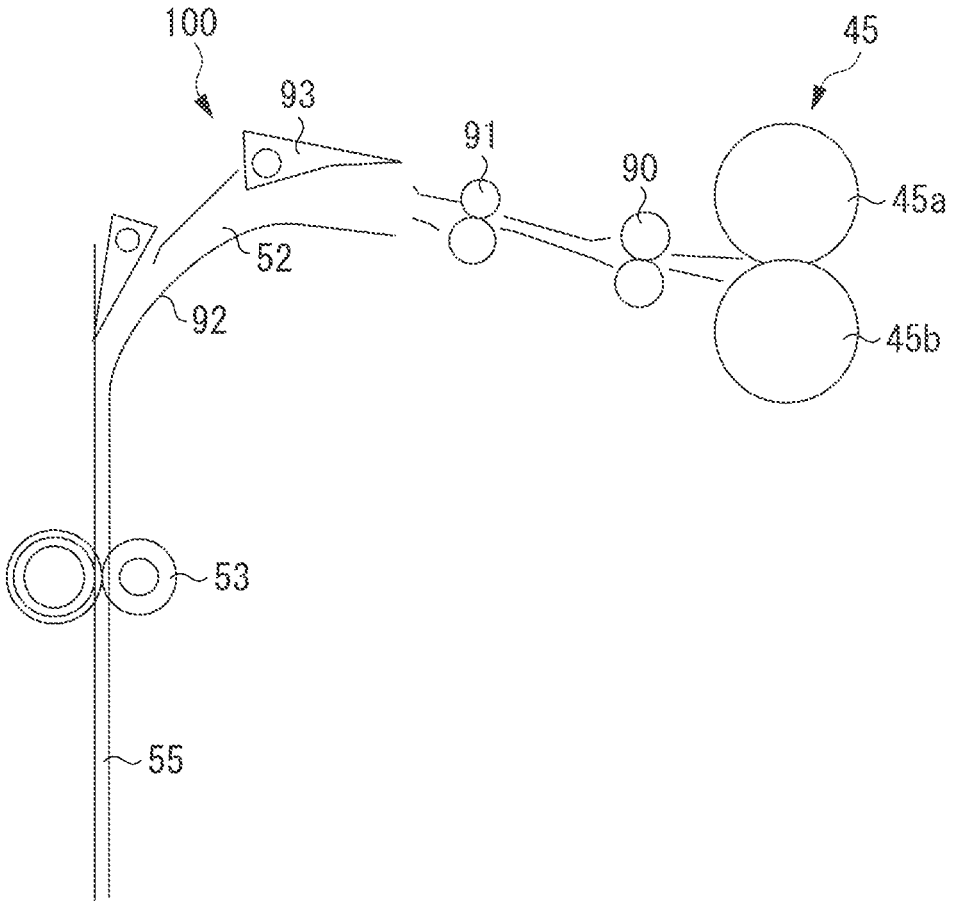
FIG. 3 is a diagram illustrating a configuration of the sheet conveyance apparatus.

The fixing device 45 applies predetermined pressure force and heat which is usually generated by a heat source such as a heater, to the sheet S to melt-fix the toner image on the sheet S. In a case of discharging the sheet S, which has a thus fixed image, directly to the sheet processing apparatus 2, the sheet S is sent to a discharge conveyance path 51, by inside-fixing-device discharge rollers 90 and outside-fixing-device discharge rollers 91 that are illustrated in FIG. 3 as described below. After that, the sheet S is discharged by an outer discharge roller 49.

When forming an image on two sides, the sheet S is sent to a curved reversing guidance path 52 by a path switching unit 93 illustrated in FIG. 3 as described below. After that, the sheet S is pulled from the reversing guidance path 52 into a switchback path 55 by upper reverse rollers 53 and lower reverse rollers 54. By performing the switchback operation in normal rotation and reverse rotation of the lower reverse rollers 54, the leading edge and the trailing edge are exchanged and then the sheet S is conveyed to a two-side conveyance path 47.

Next, the sheet S rejoins the original path in synchronized timing with a following sheet S, being conveyed by conveyance rollers 48*a*-48*d* which are provided on the two-side conveyance path 47, in synchronization with the following sheet S conveyed by the pickup rollers 36-39 or the paper supply roller 35. After that, the sheet S is sent to the secondary transfer unit 1F via the registration roller 42. The following image formation process for the back surface (second side) is similar to that for the front surface (first side) described above.

To discharge the sheet S in an inversed manner, the sheet S is pulled from the reversing guidance path 52 into the switchback path 55 by the upper reverse rollers 53 and the lower reverse rollers 54. After that, by reversing the upper reverse rollers 53 and the lower reverse rollers 54, the pulled-in sheet S is conveyed in a direction opposite to a pulled-in direction, with the pulled-in trailing edge reversed to be the leading edge. The sheet S is then sent to a reversing conveyance path 56. After that, the sheet S is reversed in such a way that a downstream end and an upstream end in the sheet conveyance direction are inversely placed, and is discharged to the sheet processing apparatus 2 by the outer discharge roller 49 via the buffer unit 3.

The sheet S, which is guided by the discharge conveyance path 51 or the reversing conveyance path 56 and is discharged from the printer body 1A by the outer discharge roller 49, is conveyed to a buffer path 81 provided in the buffer unit 3. After that, the sheet S is conveyed to a finisher conveyance path 82 provided in the sheet processing apparatus 2, processed by the sheet processing apparatus 2, and discharged to a discharge tray 2*a*.

FIG. 3 is a diagram illustrating a configuration of a sheet conveyance apparatus 100 that conveys the sheet S from the fixing device 45 to the switchback path 55 via the reversing guidance path 52. The sheet conveyance apparatus 100 includes the inside-fixing-device discharge rollers 90 and the outside-fixing-device discharge rollers 91, both of which are arranged in the downstream of the fixing device 45. Further, the sheet conveyance apparatus 100 includes the upper reverse rollers 53 arranged in the reversing guidance path 52.

The fixing device 45 includes a heating roller 45*a*, within which a heat source such as a heater is included, and a fixing roller 45*b*. When a sheet passes through the nip (hereinafter called a fixing nip) between the heating roller 45*a* and the fixing roller 45*b*, heat and pressure are applied to fix a toner image on the sheet surface. This fixing roller 45*b* is driven at the speed of x (mm/s), the inside-fixing-device discharge rollers 90 is driven at the driving speed 5% higher than the driving speed x (mm/s), and the outside-fixing-device discharge rollers 91, which works as a first conveyance roller, is driven at the speed 3% higher than the driving speed x (mm/s). In this exemplary embodiment, the driving speed represents the sheet conveyance speed at the roller nip.

Figure 4A:
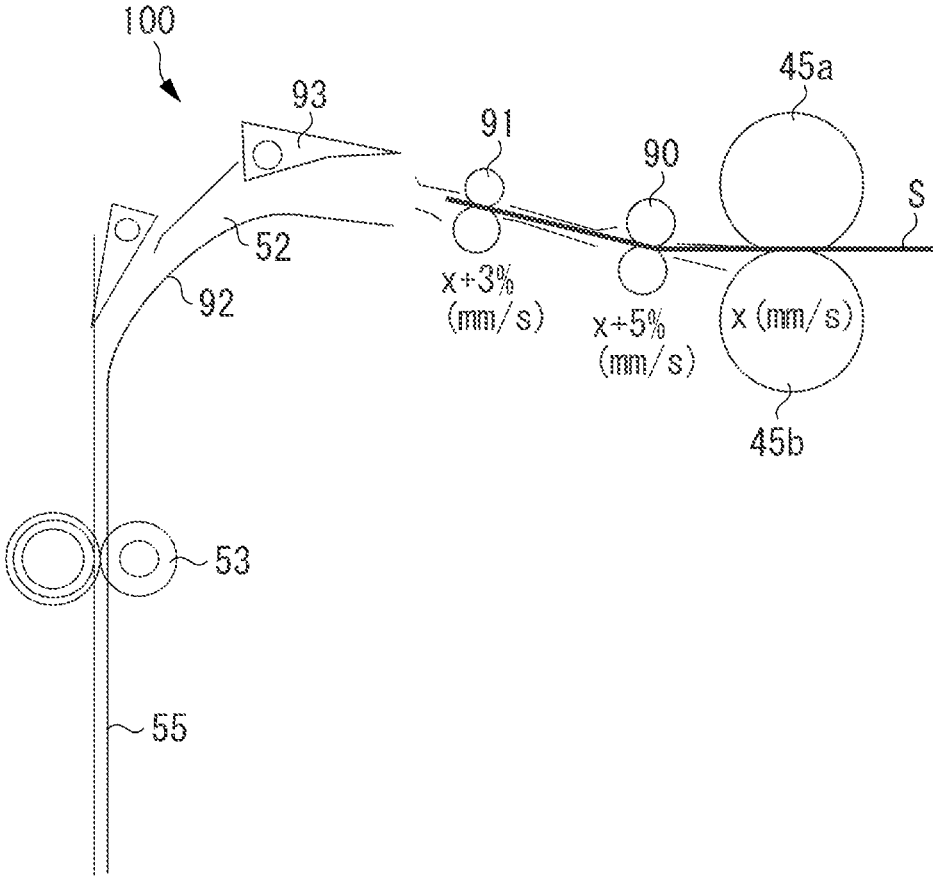
FIGS. 4A and 4B are first diagrams illustrating a sheet conveyance operation of the sheet conveyance apparatus.

The pressure force of the fixing roller 45*b*, inside-fixing-device discharge rollers 90, and outside-fixing-device discharge rollers 91 are in the following relation: fixing roller 45*b*>inside-fixing-device discharge rollers 90>outside-fixing-device discharge rollers 91. Setting the pressure force in this way prevents a downstream roller from pulling the sheet S from its upstream roller. Therefore, when the sheet S is conveyed by the three rollers, 45*b*, 90, and 91, as illustrated in FIG. 4A, the sheet S is always stretched.

Figure 4B:
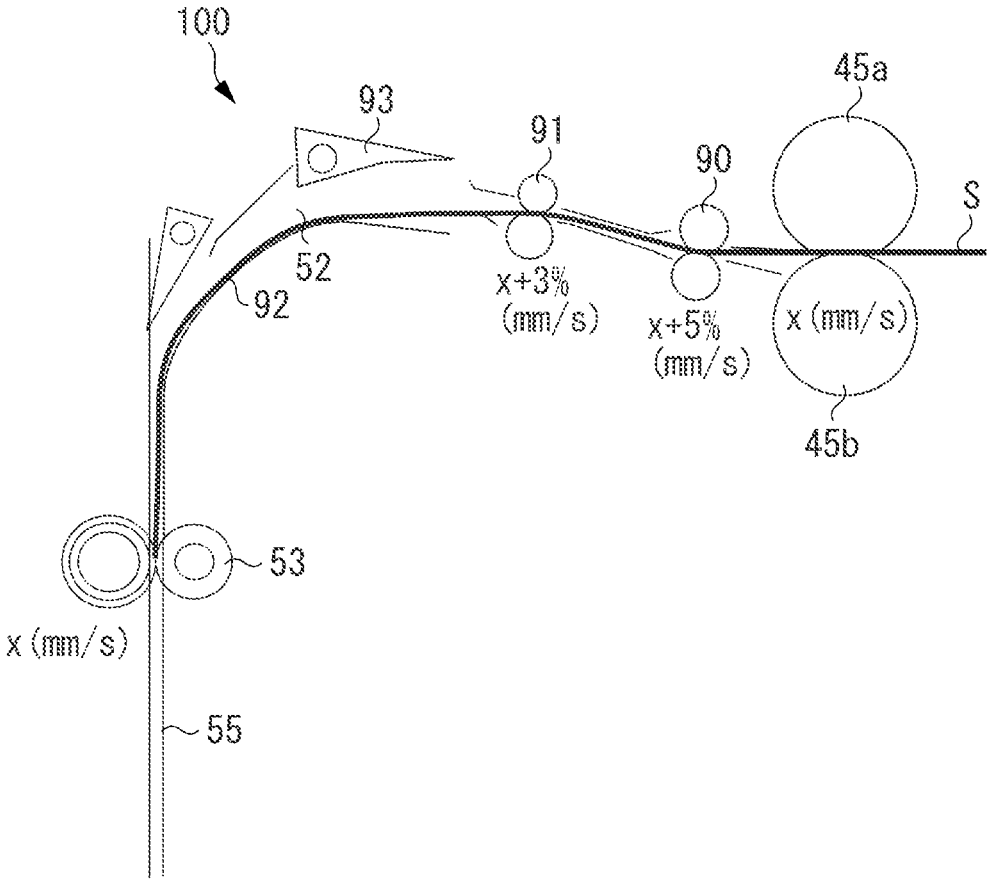
Figure 5A:
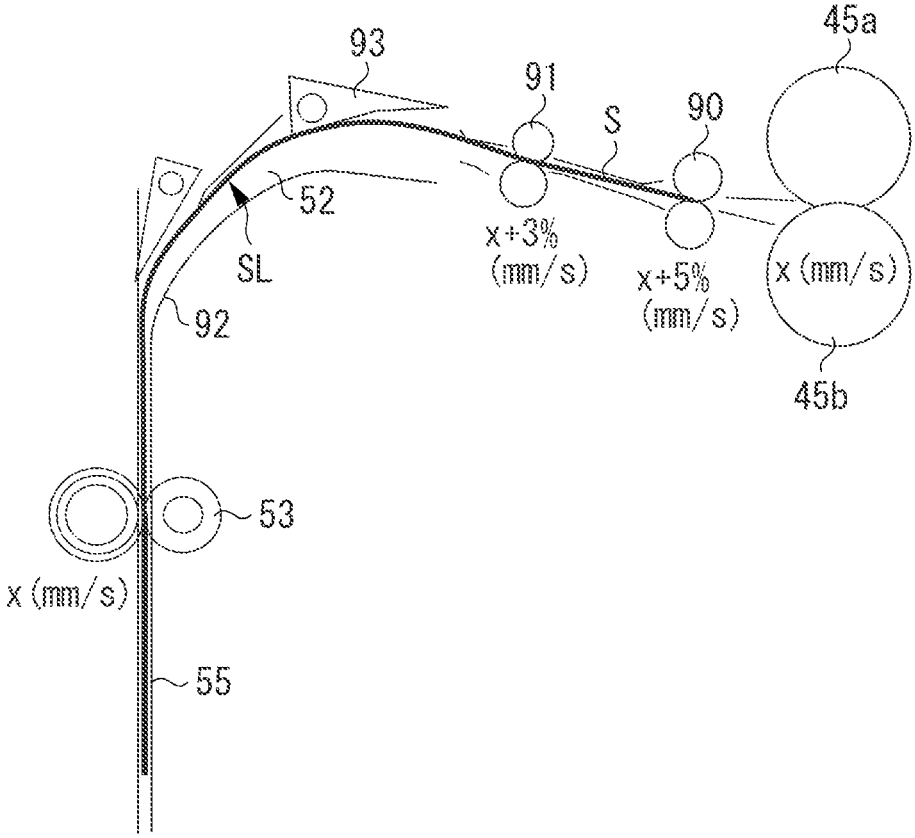
FIGS. 5A and 5B are second diagrams illustrating a sheet conveyance operation of the sheet conveyance apparatus.

On the other hand, the driving speed of the upper reverse rollers 53, which works as a second conveyance roller, is driven at the driving speed x (mm/s) same as the fixing roller 45*b* that is lower than the sheet conveyance speed of the outside-fixing-device discharge rollers 91. The pressure force of the upper reverse rollers 53 is set higher than that of the outside-fixing-device discharge rollers 91. This means that, while conveyed by the fixing roller 45*b* and the upper reverse rollers 53 as illustrated in FIG. 4B, the sheet S is stretched. However, when the trailing edge of the sheet S leaves the fixing nip and the inside-fixing-device discharge rollers 90 as illustrated in FIG. 5A, the driving speed of the outside-fixing-device discharge rollers 91 becomes higher than that of the upper reverse rollers 53. This difference in driving speed forms a loop SL in the sheet S between the outside-fixing-device discharge rollers 91 and the upper reverse rollers 53.

As described above, the reverse rotation of the upper reverse rollers 53 and the lower reverse rollers 54 (see FIG. 2) causes the sheet S pulled into the switchback path 55, to exit from the switchback path 55 in the direction opposite to the pulled-in direction, with the pulled-in trailing edge reversed to be the leading edge. However, on high-productivity color laser printer 1, the distance between the sheet S and the following sheet is short. As a result, when the sheet S is pulled into the switchback path 55, the conveyance speed of x (mm/s) causes a collision between the sheet S and the following sheet.

To prevent the collision between the sheet S and the following sheet, the driving speed, at which the sheet S is pulled by the upper reverse rollers 53 into the switchback path 55, is increased (accelerated), for example, to 2x (mm/s). That is, the driving speed of the upper reverse rollers 53, which works as the second conveyance roller when pulling the sheet S into the switchback path 55, is set to 2x (mm/s) that is higher than the driving speed of the outside-fixing-device discharge rollers 91 that works as the first conveyance roller. As described above, the contact pressure (pressure force) between the heating roller 45*a* and the fixing roller 45*b* is much larger than that of the other rollers. Therefore, the driving speed of the upper reverse rollers 53 is increased (accelerated) to 2x (mm/s) when the sheet advances z (mm) or more after the trailing edge of the sheet S leaves the fixing nip, for example.

Figure 5B:
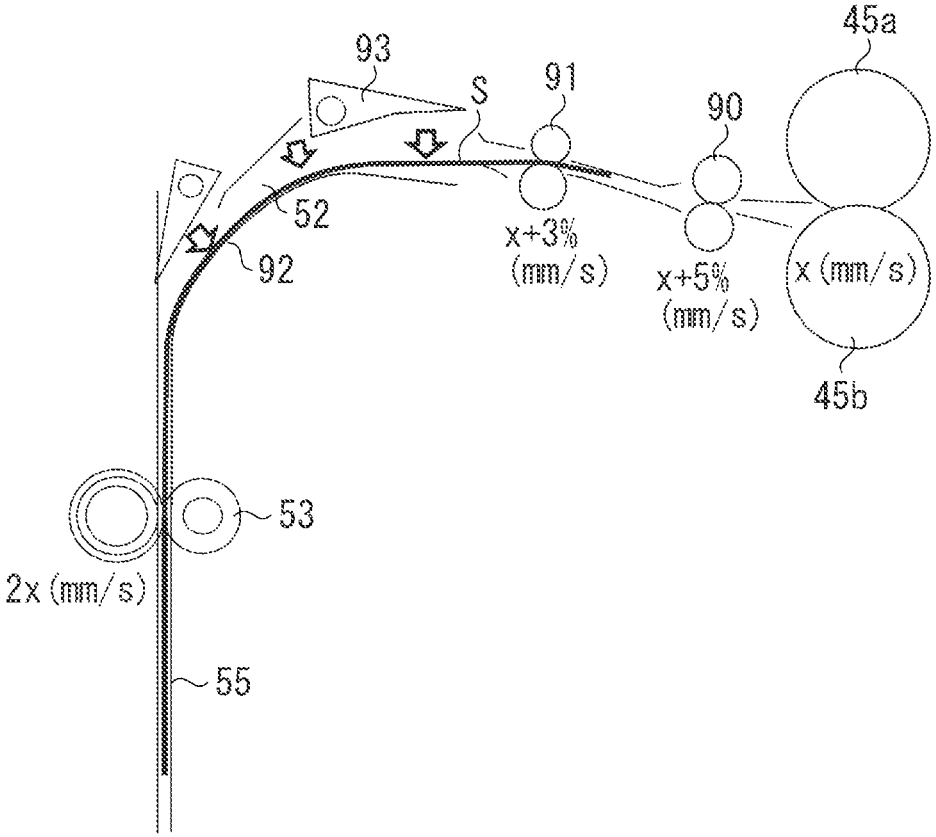

However, at this time, the trailing edge of the sheet has not yet passed through the outside-fixing-device discharge rollers 91 as illustrated in FIG. 5B. Therefore, the difference in driving speed (difference in sheet conveyance speed) between the outside-fixing-device discharge rollers 91 and the upper reverse rollers 53 quickly eliminates the loop SL formed on the sheet S. This causes the sheet S to collide with a lower guide 92 that configures the inside guide of the reversing guidance path 52, which generates a noise.

When the sheet S collides with the lower guide, the larger the acceleration in an arrow-indicated direction, i.e., a direction perpendicular to the lower guide 92, the larger the noise level. This is because an amount of acceleration, with which the sheet S collides with the lower guide 92, is proportional to the amount of impact when the sheet S collides with the lower guide 92. In this configuration, since the reversing guidance path 52 is bent and projected into the direction opposite to the arrow direction, the pressure is increased when the sheet S collides with the projection of the lower guide 92 that is the conveyance guide, further increasing the noise when the sheet S collides with the lower guide 92.

Accordingly, in this exemplary embodiment, the acceleration of the sheet conveyance speed of the upper reverse rollers 53 is variable from x to 2x. The upper reverse rollers 53 are arranged in the downstream side of the outside-fixing-device discharge rollers 91 in the sheet conveyance direction. To prevent the generation of the noise when such a loop SL is quickly eliminated, the driving speed of the upper reverse rollers 53 is increased in incremental steps when the driving speed is increased from x (mm/s), which the first sheet conveyance speed, to 2x (mm/s) which is the second sheet conveyance speed. As a result, a loop of the sheet is eliminated while changing the decreasing rate.

Figure 6:
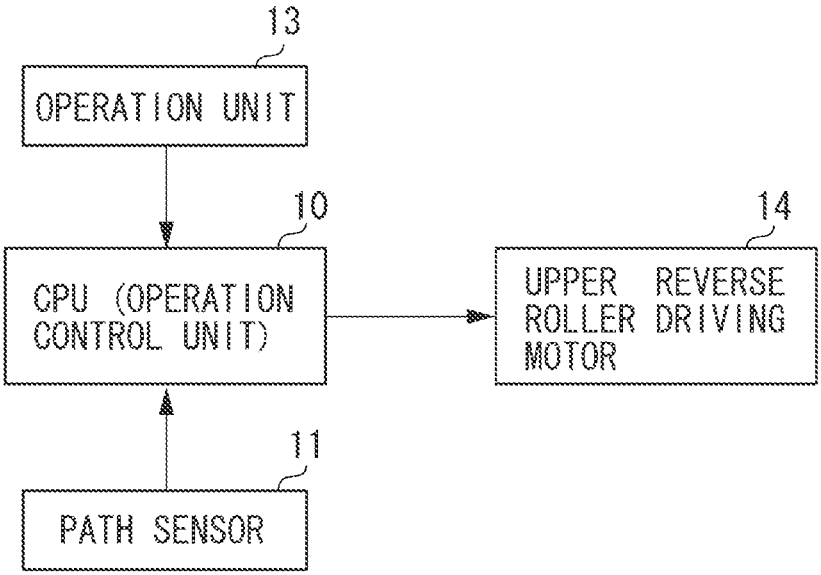
FIG. 6 is a control block diagram of the sheet conveyance apparatus.

FIG. 6 is a control block diagram of the sheet conveyance apparatus 100. In FIG. 6, a central processing unit (CPU) 10 is a control unit (operation control unit) for controlling the driving speed of the upper reverse rollers 53. The path sensor 11 is provided in the downstream side of the fixing device 45 in the sheet conveyance direction to detect the position information about a sheet. A path sensor 11 is connected to the CPU 10. In addition, an operation unit 13, which receives information about a sheet type, and a reversing upper roller driving motor 14, which is a driving unit for driving the upper reverse rollers 53, are connected to the CPU 10.

Figure 7:
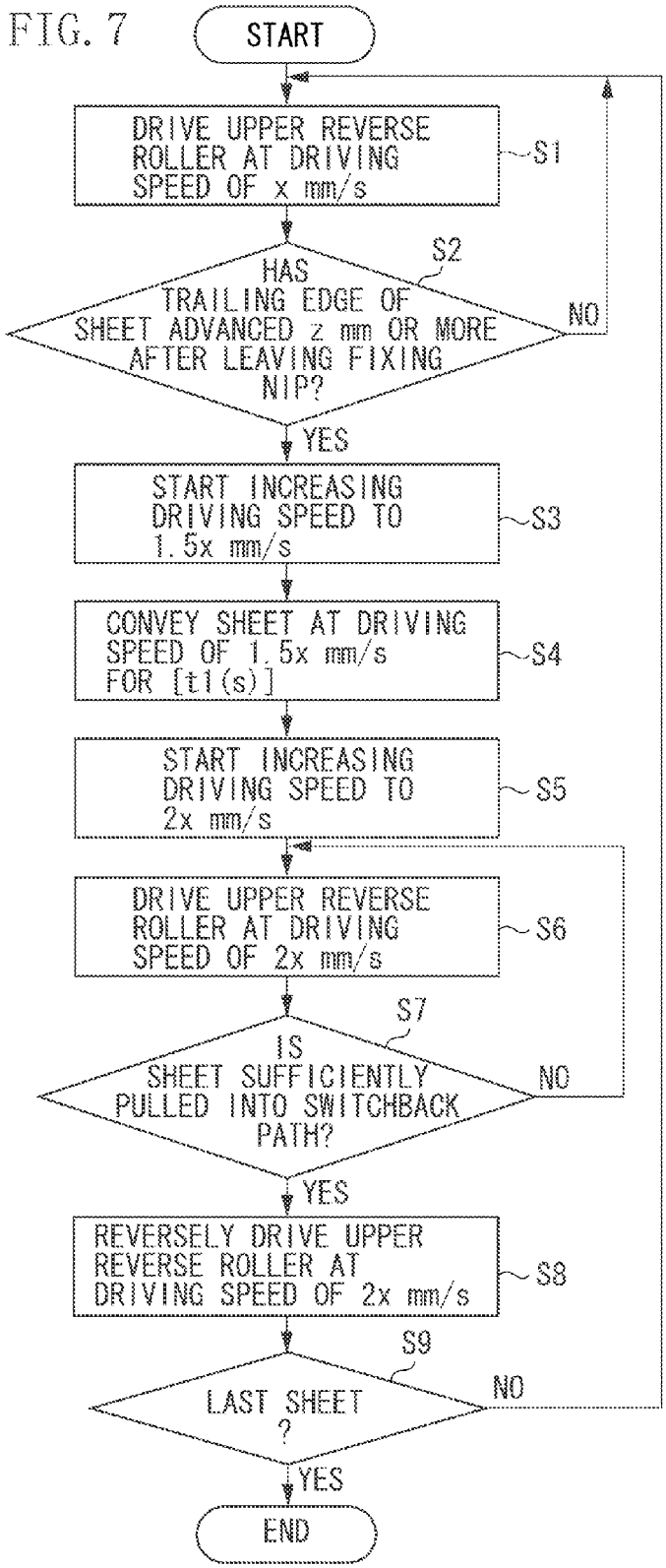
FIG. 7 is a flowchart illustrating speed increase control of the sheet conveyance apparatus.

Next, the speed increase control of the upper reverse rollers 53 performed by the CPU 10 according to the present exemplary embodiment is described with reference to the flowchart illustrated in FIG. 7. In step S1, the CPU 10 drives the upper reverse rollers 53 at the driving speed of x (mm/s) until the sheet S being conveyed in a reversed manner, leaves the fixing nip. Next, in step S2, the CPU 10 determines whether the upper reverse rollers 53 have conveyed the sheet S by a predetermine amount, that is, whether the trailing edge of the sheet S has advanced z (mm) or more after leaving the fixing nip, based on the signal from the path sensor 11. The path sensor 11 is a detection unit for detecting whether the upper reverse rollers 53 have conveyed a sheet a predetermined amount.

In step S3, if it is determined that the trailing edge of the sheet S has advanced z (mm) or more after leaving the fixing nip (Yes in step S2), the CPU 10 starts increasing the driving speed of the upper reverse rollers 53 from x (mm/s) to 1.5x (mm/s) so that the driving speed becomes higher than the driving speed of the outside-fixing-device discharge rollers 91. By performing a primary increase of the driving speed of the upper reverse rollers 53 in this manner, a loop of the sheet S generated due to a difference in sheet conveyance speed between the outside-fixing-device discharge rollers 91 and the upper reverse rollers 53 illustrated in FIG. 5A, is gradually decreased.

Figure 8:
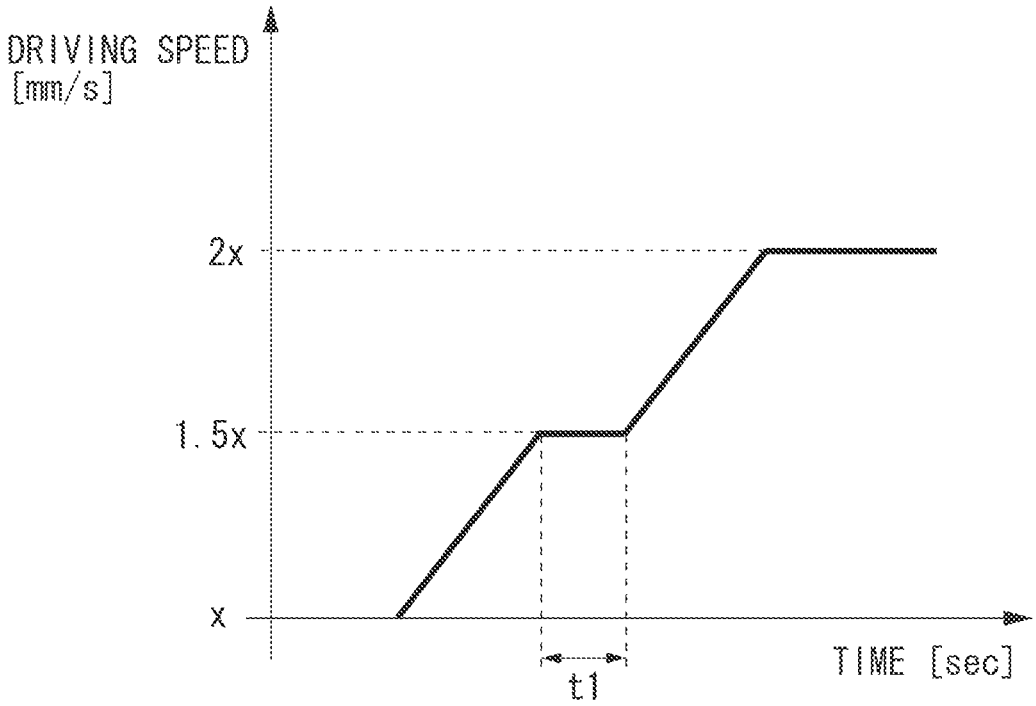
FIG. 8 is a diagram illustrating a sheet-conveyance speed change of the sheet conveyance apparatus.

Next, in step S4, the CPU 10 sets the driving speed of the upper reverse rollers 53 to 1.5x (mm/s) for a predetermined period t1 (s), as illustrated in FIG. 8, after the primary speed increase from x (mm/s) to 1.5x (mm/s) is finished. That is, for the period t1 (s) after the primary speed increase is finished, the CPU 10 sets the driving speed of the upper reverse rollers 53 to 1.5x (mm/s). In this exemplary embodiment, a loop of the sheet S between the outside-fixing-device discharge rollers 91 and the upper reverse rollers 53 is eliminated during the predetermined period t1 (s).

This operation is described below in terms of acceleration. The acceleration is switched while the conveyance speed is increased from x to 2x. A loop is eliminated during t1 (s) as illustrated in FIG. 8, while the upper reverse rollers 53 are driven at a constant speed with acceleration zero which is the lower one of accelerations before and after the switching. By eliminating a loop of the sheet S while the upper reverse rollers 53 are driven at a constant speed with acceleration zero ($mm/s^2$) in the predetermined period t1 (s), the impact caused by the sheet S abutting on the lower guide 92 is decreased and, therefore, the noise is reduced.

In step S5, after the upper reverse rollers 53 are driven at a constant speed at 1.5x (mm/s) for t1 (s), the CPU 10 starts a secondary speed increase of the upper reverse rollers 53 from 1.5x (mm/s) to 2x (mm/s) as illustrated in FIG. 8. By performing the secondary speed increase in this manner, the difference in sheet conveyance speed between the outside-fixing-device discharge rollers 91 and the upper reverse rollers 53 is increased. Because the pressure force of the upper reverse rollers 53 is higher than that of the outside-fixing-device discharge rollers 91, the sheet S is conveyed at the sheet conveyance speed of the upper reverse rollers 53.

Next, in step S6, the CPU 10 drives the upper reverse rollers 53, whose speed is increased in the secondary speed increase, at the driving speed of 2x (mm/s). After that, in step S7, the CPU 10 determines whether the sheet is sufficiently pulled into the switchback path 55 based on the signal from the path sensor 11. If it is determined that the sheet is sufficiently pulled into the switchback path 55 (Yes in step S7), the CPU 10 drives the upper reverse rollers 53 in reverse rotation in step S8 at the driving speed of 2x (mm/s) to send the sheet to the reversing conveyance path 56. Next, in step S9, the CPU 10 determines whether the sheet is the last sheet. If the sheet is not the last sheet (No in step S9), the CPU 10 repeats steps S1-S9 described above. If the sheet is the last sheet (Yes in step S9), the CPU 10 stops the conveyance of the sheet.

In this exemplary embodiment, when the upper reverse rollers 53 and the outside-fixing-device discharge rollers 91 work together to convey a sheet, the sheet conveyance speed of the upper reverse rollers 53 is set to x (mm/s), which is lower than the sheet conveyance speed of the outside-fixing-device discharge rollers 91, until the upper reverse rollers 53 convey the sheet a predetermined amount. When the upper reverse rollers 53 convey the sheet the predetermined amount, the sheet conveyance speed of the upper reverse rollers 53 is increased in incremental steps from x (mm/s) to 2x (mm/s). In this manner, a loop of the sheet generated due to difference in a sheet conveyance speed from the outside-fixing-device discharge rollers 91 is eliminated in incremental steps.

That is, according to the present exemplary embodiment, the sheet conveyance speed of the upper reverse rollers 53 is increased such that a loop of a sheet is eliminated by reducing the loop reduction rate during the operation. This minimizes the acceleration in the direction perpendicular to the lower guide 92 when the sheet S abuts on the lower guide 92. As a result, this configuration prevents the loop of the sheet from being eliminated quickly, thus reducing the noise generated when the loop is eliminated while maintaining the advantage of low cost, space saving, and high productivity.

The final speed of 1.5x (mm/s) of the primary speed increase described above is a value obtained by experiment. In addition, the relation between a noise level and the final speed of the primary speed increase varies according to the value of x, the loop growth time, and the value of the final speed of the secondary speed increase (2x in this exemplary embodiment) or according to the curvature of a bending path, the pressure force of the upper reverse rollers 53 and outside-fixing-device discharge rollers 91, and the type of sheet. Therefore, it is desirable to find out the final speed of the primary speed increase suitable for a target system. Although the speed increase is divided into two, i.e., primary speed increase and secondary speed increase, in the present exemplary embodiment, the number of divisions of the speed increase is not limited to two but may be three or more.

The driving speed of the upper reverse rollers 53 is increased in incremental steps to prevent the noise from being generated in a case where a loop is quickly eliminated, as described above. Additional embodiments are not limited to incremental speed increase. For example, the acceleration when the driving speed of the upper reverse rollers 53 is increased from x (mm/s) to 2x (mm/s), may also be changed.

Next, a sheet conveyance apparatus according to a second exemplary embodiment is described in which the acceleration when the driving speed of the upper reverse rollers 53 is increased, is changed.

Figure 9:
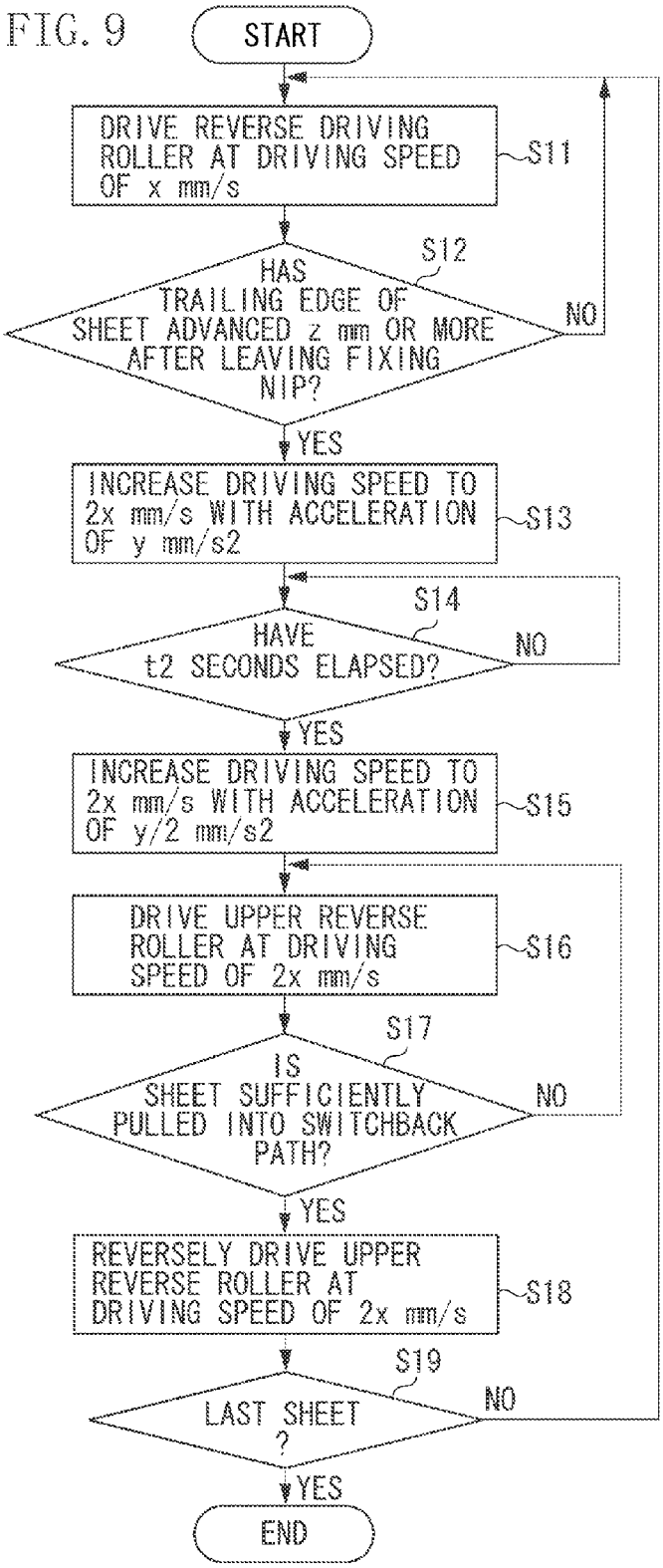
FIG. 9 is a flowchart illustrating speed increase control of a sheet conveyance apparatus in a second exemplary embodiment.

FIG. 9 is a flowchart illustrating speed increase control of a sheet conveyance apparatus 100 in this exemplary embodiment. In step S11, the CPU 10 drives the upper reverse rollers 53 at the driving speed of x (mm/s) until the sheet S, conveyed in a reversed manner, leaves the fixing nip. Next, in step S12, the CPU 10 determines whether the trailing edge of the sheet S has advanced z (mm) or more after leaving the fixing nip, based on the signal from the path sensor 11.

In step S13, if it is determined that the trailing edge of the sheet S has advanced z (mm) or more after leaving the fixing nip (Yes in step S12), the CPU 10 starts increasing the driving speed of the upper reverse rollers 53 from x (mm/s) to 2x (mm/s) with the acceleration of y (mm/s$^2$). By performing a primary increase of the driving speed in this manner, a loop of the sheet S, generated due to a difference in sheet conveyance speed between the outside-fixing-device discharge rollers 91 and the upper reverse rollers 53 illustrated in FIG. 5A, is gradually decreased.

Figure 10:
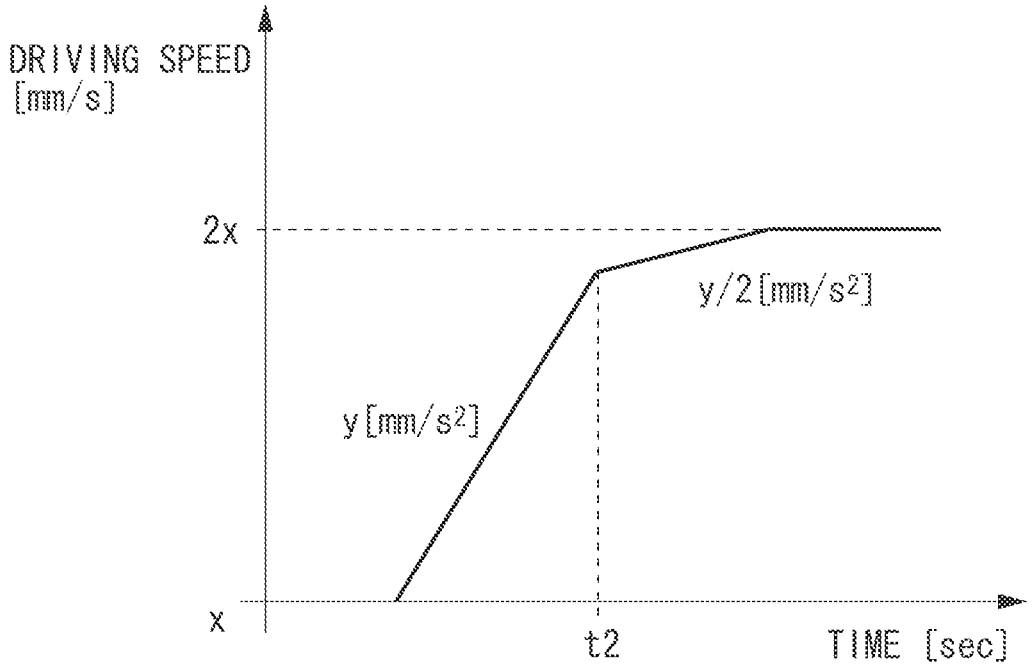
FIG. 10 is a diagram illustrating a sheet-conveyance speed change of the sheet conveyance apparatus.

Next, the CPU 10 performs the primary speed increase (primary acceleration) to 2x (mm/s) with the above acceleration of y (mm/s$^2$) up to t2 (s) as illustrated in FIG. 10. In step S15, when t2 (s) has elapsed (Yes in step S14), the CPU 10 changes the acceleration to y/2 (mm/s$^2$) and starts increasing the driving speed of the upper reverse rollers 53 to 2x (mm/s). According to the present exemplary embodiment, a loop of the sheet S between the outside-fixing-device discharge rollers 91 and the upper reverse rollers 53 is eliminated when t2 (s) has elapsed.

By performing the primary speed increase (primary acceleration) and the secondary speed increase (secondary acceleration) in this manner, the difference in sheet conveyance speed between the outside-fixing-device discharge rollers 91 and the upper reverse rollers 53 is increased. This eliminates a loop of the sheet S and the sheet S abuts on the lower guide 92 as illustrated in FIG. 5B. At this time, the acceleration of the secondary speed increase of the sheet S is lower than the acceleration of the primary speed increase. Therefore, when the loop is eliminated by the secondary speed increase and the sheet S abuts on the lower guide 92, the noise is reduced as compared to the case in which the sheet S abuts on the lower guide 92 with the acceleration of the primary speed increase. Even after the loop is eliminated and the sheet S abuts on the lower guide 92, the secondary speed increase is continued until the driving speed of the upper reverse rollers 53 reaches 2x (mm/s). However, because the pressure force of the upper reverse rollers 53 is higher than the pressure force of the outside-fixing-device discharge rollers 91, the sheet S is conveyed at the sheet conveyance speed of the upper reverse rollers 53.

Next, in step S16, the CPU 10 drives the upper reverse rollers 53, whose speed is increased by the secondary speed increase, at the driving speed of 2x (mm/s). After that, in step S17, the CPU 10 determines whether the sheet is sufficiently pulled into the switchback path 55 based on the signal from the path sensor 11. If it is determined that the sheet is sufficiently pulled into the switchback path 55 (Yes in step S17), the CPU 10 drives the upper reverse rollers 53 to perform reverse rotation in step S18 at the driving speed of 2x (mm/s) to send the sheet to the reversing conveyance path 56. Next, in step S19, the CPU 10 determines whether the sheet is the last sheet. If the sheet is not the last sheet (No in step S19), the CPU 10 repeats steps S11-S19 described above. If the sheet is the last sheet (Yes in step S19), the CPU 10 stops the conveyance of the sheet.

In this exemplary embodiment, a loop is quickly decreased by performing the primary increase (primary acceleration) after the trailing edge of the sheet S passes through the fixing nip as described above. In addition, the acceleration is decreased immediately before the sheet abuts on the lower guide 92 to change the speed to the secondary speed increase (secondary acceleration) to eliminate a loop. This configuration reduces the acceleration in the direction perpendicular to the lower guide 92 when the sheet S collides with the lower guide 92.

That is, the present exemplary embodiment increases the driving speed of the upper reverse rollers 53 in such a way that the decrease rate of a loop of a sheet is reduced in midstream and then the loop is eliminated by changing the acceleration when the driving speed is increased. In other words, the secondary speed increase is performed in such a way that the decrease rate of a loop of a sheet is decreased in midstream and then the loop is eliminated by switching the acceleration to a lower acceleration at the time of the secondary speed increase. As a result, this configuration prevents the loop of the sheet from being eliminated quickly, thus reducing noise generated when the loop is eliminated while maintaining the advantage of low cost, space saving, and high productivity.

Although the speed increase is divided into two, i.e., primary speed increase (primary acceleration) and secondary speed increase (secondary acceleration), in the present exemplary embodiment, the number of divisions of the speed increase, that is, the number of accelerations to be switched over is not limited to two but may be three or more.

Figure 11:
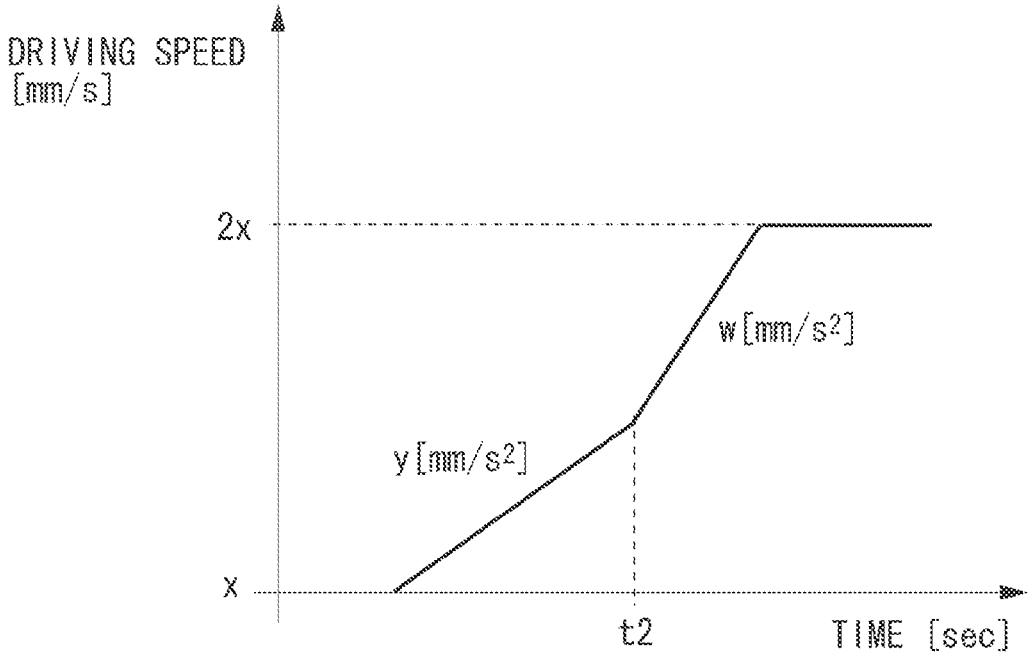
FIG. 11 is another diagram illustrating a sheet-conveyance speed change of the sheet conveyance apparatus.

It is also effective to set the acceleration y ($mm/s^2$) of the primary acceleration lower than the acceleration w ($mm/s^2$) of the secondary acceleration as illustrated in FIG. 11 so that a loop is gradually eliminated with the primary acceleration and then the secondary acceleration is performed. That is, a loop of a sheet is eliminated at the time of the primary speed increase (primary acceleration) in which the acceleration is lower and then the acceleration is increased at the time of the secondary speed increase (secondary acceleration) to ensure productivity while reducing the impact generated when the sheet S abuts on the lower guide 92. The values of the primary acceleration and the secondary acceleration should be selected appropriately according to the actual embodiment.

After the second conveyance rollers conveys a sheet a predetermined amount, the sheet conveyance speed of the second conveyance roller is increased according to the present embodiment(s) so that a loop of the sheet is eliminated while changing the decrease rate during the operation. This control reduces the noise generated when the loop of the sheet is eliminated.

While the present disclosure has been described with reference to exemplary embodiments, these embodiments are not seen to be limiting. The scope of the following claims is to be accorded the broadest interpretation so as to encompass all such modifications and equivalent structures and functions.

This application claims the benefit of Japanese Patent Application No. 2012-189941 filed Aug. 30, 2012, which is hereby incorporated by reference herein in its entirety.

What is claimed is:

1. A sheet conveyance apparatus comprising:

a first conveyance roller configured to convey a sheet;

a second conveyance roller configured to convey the sheet at a variable speed ranging from a first sheet conveyance speed to a second sheet conveyance speed, wherein the second conveyance roller is arranged downstream of the first conveyance roller in a sheet conveyance direction side by side, wherein the first sheet conveyance speed is less than a sheet conveyance speed of the first conveyance roller and the second sheet conveyance speed is greater than the sheet conveyance speed of the first conveyance roller;

a driving unit configured to drive the second conveyance roller; and a control unit configured to control the driving unit, wherein the control unit controls the driving unit so that the second conveyance roller, in conjunction with the first conveyance roller, conveys a sheet, at the first sheet conveyance speed, to generate a loop on the sheet until the second conveyance roller conveys the sheet a predetermined amount, and after the second conveyance roller has conveyed the sheet the predetermined amount, an acceleration of the second conveyance roller is switched while the sheet conveyance speed of the second conveyance roller is increasing from the first sheet conveyance speed to the second sheet conveyance speed, and the loop is eliminated while the sheet conveyance speed of the second conveyance roller is increasing from the first sheet conveyance speed to the second sheet conveyance speed with a lower acceleration of accelerations before and after the switching.

2. The sheet conveyance apparatus according to claim 1, wherein, the control unit controls the driving unit such that the acceleration is switched to zero as the lower acceleration while the sheet conveyance speed of the second conveyance roller is increasing from the first sheet conveyance speed to the second sheet conveyance speed.

3. The sheet conveyance apparatus according to claim 1, wherein, the control unit controls the driving unit such that the acceleration is switched to the lower acceleration while the sheet conveyance speed of the second conveyance roller is increasing from the first sheet conveyance speed to the second sheet conveyance speed.

4. The sheet conveyance apparatus according to claim 1, wherein, the control unit controls the driving unit such that the acceleration is switched to a higher acceleration while the sheet conveyance speed of the second conveyance roller is increasing from the first sheet conveyance speed to the second sheet conveyance speed.

5. The sheet conveyance apparatus according to claim 1, further comprising a detection unit configured to detect that the second conveyance roller has conveyed the sheet the predetermined amount.

6. The sheet conveyance apparatus according to claim 1, further comprising a conveyance guide provided between the first conveyance roller and the second conveyance roller and on which the sheet abuts when the loop is eliminated.

7. The sheet conveyance apparatus according to claim 6, wherein the conveyance guide is bent and projected in a direction in which the loop is formed.

8. An image forming apparatus comprising:

an image forming unit configured to form an image on a sheet;

a first conveyance roller configured to convey the sheet on which the image is formed;

a second conveyance roller configured to convey the sheet at a variable speed ranging from a first sheet conveyance speed to a second sheet conveyance speed, wherein the second conveyance roller is arranged downstream of the first conveyance roller in a sheet conveyance direction side by side, wherein the first sheet conveyance speed is less than a sheet conveyance speed of the first conveyance roller and the second sheet conveyance speed is greater than the sheet conveyance speed of the first conveyance roller;

a driving unit configured to drive the second conveyance roller; and a control unit configured to control the driving unit, wherein the control unit controls the driving unit so that the second conveyance roller, in conjunction with the first conveyance roller, conveys a sheet, at the first sheet conveyance speed, to generate a loop on the sheet until the second conveyance roller conveys the sheet a predetermined amount, and after the second conveyance roller has conveyed the sheet the predetermined amount, an acceleration of the second conveyance roller is switched while the sheet conveyance speed of the second conveyance roller is increasing from the first sheet conveyance speed to the second sheet conveyance speed, and the loop is eliminated while the sheet conveyance speed of the second conveyance roller is increasing from the first sheet conveyance speed to the second sheet conveyance speed with a lower acceleration of accelerations before and after the switching.

9. The sheet conveyance apparatus according to claim 8, wherein, the control unit controls the driving unit such that the acceleration is switched to zero as the lower acceleration while the sheet conveyance speed of the second conveyance roller is increasing from the first sheet conveyance speed to the second sheet conveyance speed.

10. The sheet conveyance apparatus according to claim 8, wherein, the control unit controls the driving unit such that the acceleration is switched to the lower acceleration while the sheet conveyance speed of the second conveyance roller is increasing from the first sheet conveyance speed to the second sheet conveyance speed.

11. The sheet conveyance apparatus according to claim 8, wherein, the control unit controls the driving unit such that the acceleration is switched to a higher acceleration while the sheet conveyance speed of the second conveyance roller is increasing from the first sheet conveyance speed to the second sheet conveyance speed.

12. The image forming apparatus according to claim 8, further comprising a detection unit configured to detect that the second conveyance roller has conveyed the sheet the predetermined amount.

13. The image forming apparatus according to claim 8, further comprising a conveyance guide provided between the first conveyance roller and the second conveyance roller and on which the sheet abuts when the loop is eliminated.

14. The image forming apparatus according to claim 13, wherein the conveyance guide is bent and projected in a direction in which the loop is formed.

* * * * *